United States Patent [19]

Crowe

[11] 4,059,157

[45] Nov. 22, 1977

[54] WELL CONTROL VALVE APPARATUS

[75] Inventor: Talmadge L. Crowe, Houston, Tex.

[73] Assignee: Baker International Corporation, Orange, Calif.

[21] Appl. No.: 716,431

[22] Filed: Aug. 23, 1976

Related U.S. Application Data

[63] Continuation-in-part of Ser. No. 652,483, Jan. 26, 1976.

[51] Int. Cl.[2] ..... E21B 43/00

[52] U.S. Cl. ..... 166/317; 166/325; 137/68 R

[58] Field of Search ..... 166/317; 137/155, 67, 137/68 R, 70, 71, 797, 512, 512.3, 628

[56] References Cited

U.S. PATENT DOCUMENTS

| | | | |
|---|---|---|---|
| 2,144,144 | 1/1939 | Crickmer | 137/155 |
| 2,855,049 | 10/1958 | Zandmer | 166/317 |
| 3,074,486 | 1/1963 | Murray, Jr. | 166/317 |
| 3,087,551 | 4/1963 | Kerver | 166/317 |
| 3,358,770 | 12/1967 | Zandmer | 166/317 |
| 3,366,182 | 1/1968 | Solum | 166/317 |
| 3,417,822 | 12/1968 | Howell | 166/317 |
| 3,831,680 | 8/1974 | Edwards et al. | 166/317 |

*Primary Examiner*—James A. Leppink

[57] ABSTRACT

Well control valve to be installed in a tubing string for use in killing a well through use of fluid under pressure pumped down through the annulus surrounding the tubing string. When the annulus pressure exceeds a predetermined value, the valve is opened to permit the kill fluid to flow into and through the tubing string into the producing formation. The valve contains spaced upper and lower closure members or rupturable discs defining an atmospheric chamber therebetween. The upstream side of the upper disc is subject to the normal hydrostatic pressure of the fluid in the annulus, and also to an increase in the pressure of the annulus fluid above normal hydrostatic pressure, but its downstream side is subjected initially to the atmospheric pressure in the chamber. Accordingly, the upper closure member or disc can be placed in its opened condition, as by rupturing it, when subjected to a predetermined increase in annulus pressure above the normal hydrostatic pressure, allowing the annulus kill fluid to flow into the atmospheric chamber to open the lower closure or disc and then flow through the tubing string to the producing formation. A check valve in the control valve permits fluid to flow from the annulus to the tubing string after the discs are ruptured, but prevents flow of fluid from the tubing string to the annulus.

34 Claims, 4 Drawing Figures

WELL CONTROL VALVE APPARATUS

Figure 1:
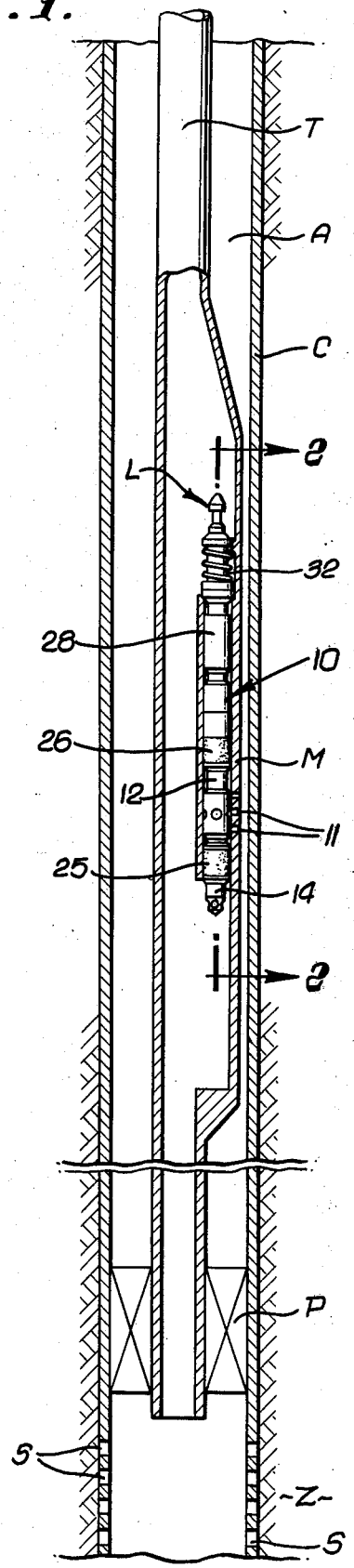

This application is a continuation-in-part of application Ser. No. 652,483, filed Jan. 26, 1976, for "Well Control Flow Apparatus."

The present invention relates to well control valves, and more particularly to control valves adapted to be incorporated in a tubing string to control the flow of fluid between a tubing-casing well annulus and the interior of the tubing string.

Control valves have been incorporated in tubing strings which are opened, when required, to establish communication between a well casing annulus surrounding a tubing string and the interior of the tubing string, for the purpose of killing a well by reverse circulation; that is, pumping kill fluid through the annulus and tubing string into the well formation. An example of a well control valve used heretofore includes a shear disc that ruptures when subjected to a predetermined differential pressure between the tubing-casing annulus pressure and the tubing pressure. During acidizing of the well, the tubing pressure may be much higher than the formation pressure or pressure of the fluid in the tubing-casing annulus. When the well is being produced, the tubing pressure may be much lower than the original well shut-in pressure. Because of different well conditions that might be encountered, the shear value of the disc must be sufficiently high to withstand the high tubing pressures associated with the well acidizing operations. As a result, a high casing-annulus pressure is required to rupture or shear the disc when the well is to be killed. This annulus pressure also varies as the tubing pressure changes, as under the different conditions above noted.

In the above application Ser. No. 652,483, and in the present application, increase in the annulus pressure required to actuate the control valve is predetermined and is not influenced by changes in the tubing pressure. Moreover, increases in tubing pressure and decreases in temperature, as might occur during well stimulation operations, do not affect the operation of the valve. The well control valve is actuated upon increase in the annulus pressure above the normal hydrostatic pressure of the fluid in the tubing-casing annulus. This increase in annulus pressure can be effected by applying pressure to the annulus fluid from the surface of the well bore. It could result from other conditions, such as a leak in the tubing string below the Christmas tree, which would allow the tubing string pressure to be imposed on the annulus fluid and add its pressure to the hydrostatic annulus fluid pressure to open the valve. If, for example, a tubing leak develops near the surface of the gas well, the bottom hole gas pressure, if sufficiently high, would produce opening of the valve, permitting the kill fluid in the annulus to be imposed on the formation and kill the well and the gas flow therefrom. If the well is not killed, the excessive casing pressure will be relieved. In the absence of such automatic opening of the valve by the high pressure gas, the latter would add to the original hydrostatic pressure in the annulus and might overpressure the casing or collapse the tubing.

Another aspect of the present invention is to provide improved valves which are insensitive to tubing pressure, since they will be opened upon the addition of a predetermined annulus pressure to the normal hydrostatic head of fluid in the annulus, and regardless of the tubing pressure or drastic fluctuations in the tubing pressure.

In the above application, Ser. No. 652,483, the control valves embody an elastomer seal ring to isolate the atmospheric chamber from the well fluid. Over a period of time, gas might migrate through the elastomer seal into the atmospheric chamber, elevating the pressure therein to substantially that of the well fluid. Accordingly, the control valve would then embody the disadvantages of the prior art devices noted above.

Yet another object of the invention is to provide valves in which the atmospheric chamber is not initially closed in dependence on an elastomer seal. Instead, fluid or gas impervious joints or bonds maintain the chamber in its initially closed condition. More specifically, upper and lower rupturable discs are provided at both ends of the atmospheric chamber, the annulus pressure acting against the upstream side of the upper disc and atmospheric pressure against the downstream side. As a result, the tripping pressure of the valve is a function of the strength of the upper disc, and no compensation for tubing pressure or temperature fluctuations need be made.

Relatively simple valve discs can be provided, and this fact, coupled with the fact that other valve parts are relatively inexpensive, makes the entire valve economical to manufacture.

In association with the atmospheric chamber being maintained in closed condition by impervious joints or metal bonds, the kill valve embodies a check valve feature, which permits fluid to flow from the tubing-casing annulus into the tubing, but prevents fluid in the tubing from flowing into the casing.

Figure 3:
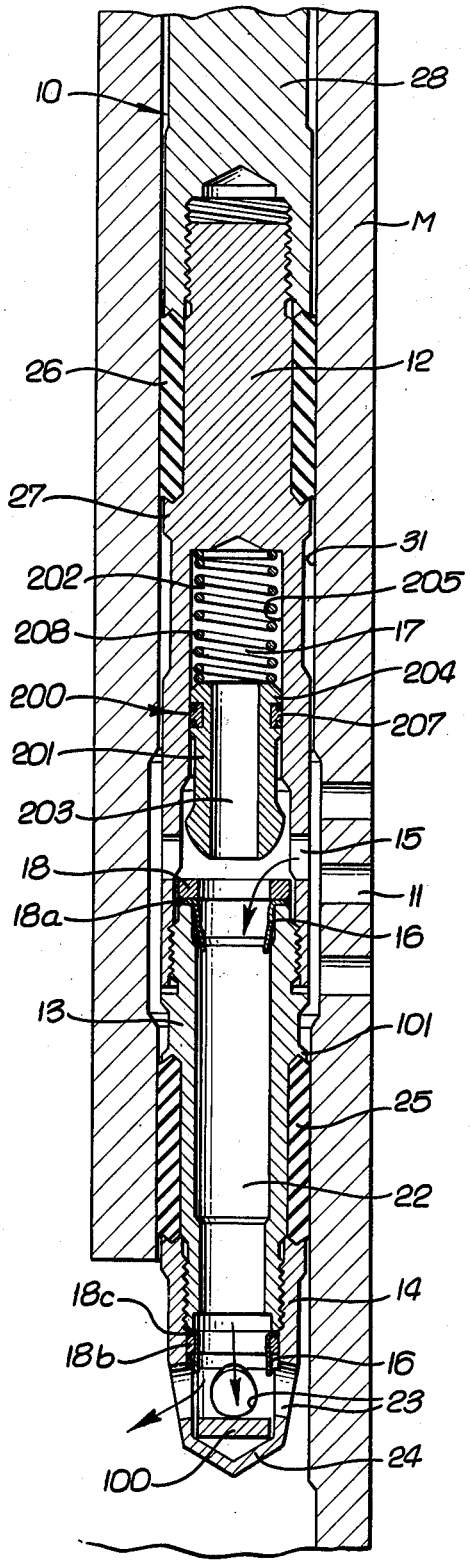

This invention possesses many other advantages, and has other objects which may be made more clearly apparent from a form in which it may be embodied. Such form is shown in the drawings accompanying and forming part of the present specification. This form will now be described in detail for the purpose of illustrating the general principles of the invention; but it is to be understood that such detailed description is not to be taken in a limiting sense. Referring to the drawings:

FIG. 1 is a diagrammatic type of view of a valve apparatus incorporated in a tubing string disposed in a well bore, parts being disclosed in side elevation and parts in longitudinal section;

FIGS. *2a* and *2b* together constitute an enlarged longitudinal section, parts being disclosed in side elevation, taken along the line 2—2 on FIG. 1, FIG. *2b* being a lower contination of FIG. *2a;* and FIG. 3 is a view similar to FIG. *2b* disclosing the valve in open condition.

As disclosed in FIG. 1, a well production tubing string T is disposed within a well casing C, the lower end of the tubing string being appropriately sealingly related to a well packer P set in packed-off condition within the well casing above a plurality of casing perforations S that permit production from a formation zone Z to flow into the well casing, and thence into the lower end of the tubing string for conveyance therethrough to the top of the well bore. The apparatus illustrated in FIG. 1 is diagrammatic in form for purpose of illustration.

A well control valve 10 is disposed in the tubing string, and more particularly in its side pocket mandrel M, which, as is well known in the art, is disposed to one side of the tubing string so as to leave an uninterrupted passage through the entire tubing string. The side pocket mandrel and valve 10 are preferably located near and above the well packer P. Fluid in the tubing-casing annulus A can pass through a plurality of openings or perforations 11 in the side pocket M to its interior, and, when the well control valve 10 is open, downwardly through the valve and into the interior of the tubing string.

Figure 2A:
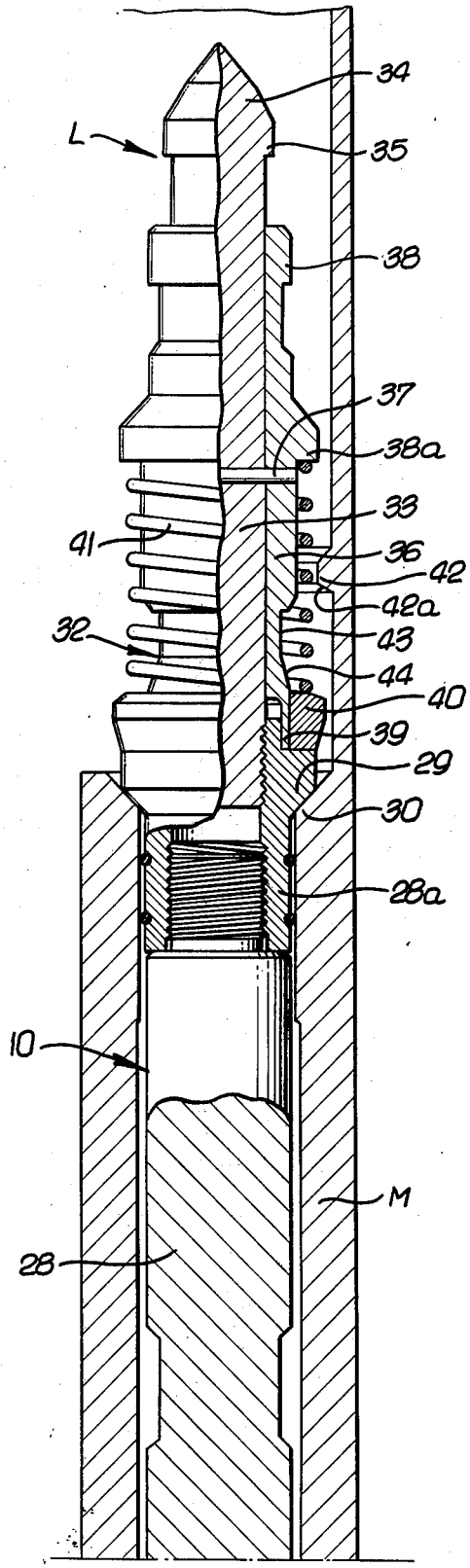
Figure 2B:
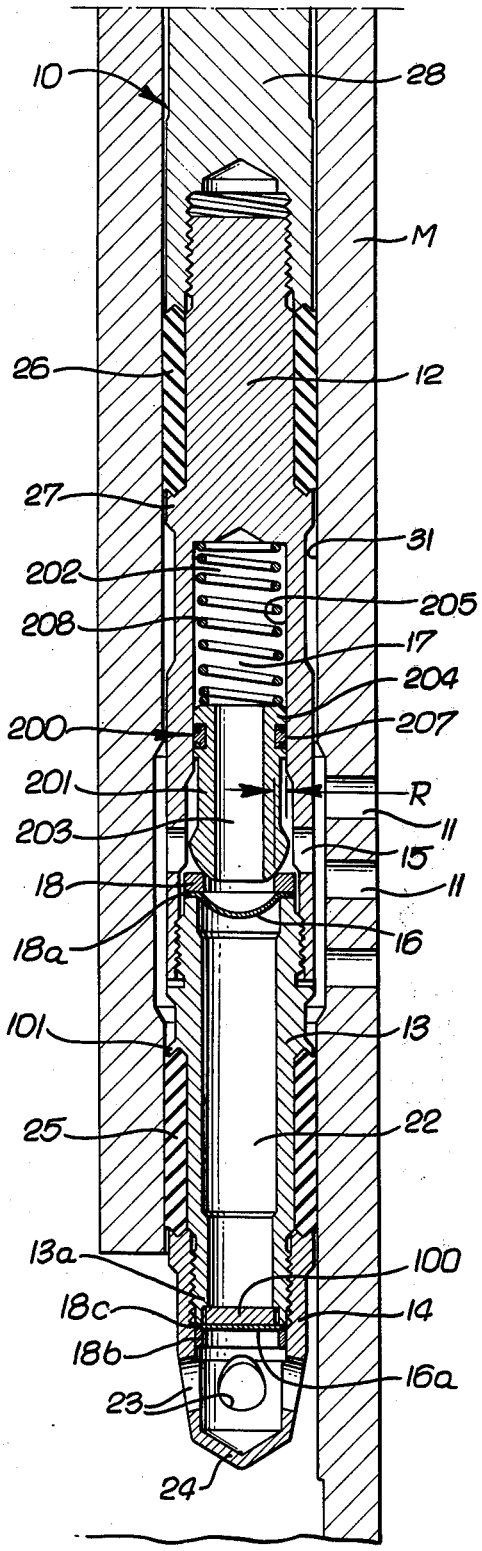

As specifically illustrated in FIGS. 2*a* and 2*b*, the valve apparatus includes an upper body portion 12, the lower end of which is threadedly secured to a lower body portion or mandrel 13, the lower end of which is, in turn, threadedly attached to a tubular plug catcher 14. Fluid flowing from the annulus A through the side pocket perforations 11 can pass through the ports 15 in the body, but initially cannot flow downwardly from the body because of the presence of a rupturable disc 16 extending across the body passage 17, this disc being disposed between a retaining ring 18 and upper end of the mandrel and secured to both the ring and mandrel by a weld or impervious metal bond or joint 18*a*. As shown, this disc is of concave form, and is made of a rupturable material so as to fracture or be disrupted when subjected to a predetermined pressure differential. The lower portion of the mandrel 13 is initially closed by a rupturable disc 16*a* disposed between a lower retaining ring 18*a* and the lower end of the mandrel 13 and secured to both the ring and mandrel by a weld 18*b* or impervious metal bond or joint. The lower disc 16*a*, is supported against upward deflection by a thick supporting disc 100 thereabove that bears against a downwardly facing mandrel shoulder 13*a*. The upper disc 16 and lower disc 16*a* initially form a confined chamber 22 which may contain air at atmospheric pressure, or other suitable gas. The lower disc is thinner than the upper disc to rupture with less force applied to its upper surface. However, force applied to its lower surface cannot disrupt it in view of the backing provided by the supporting disc 100.

The plug catcher 14 has relatively large outlet openings 23 therein. When the upper disc 16 is ruptured, the fluid pressure thereabove can enter the chamber 22 and act upon the supporting disc 100 and lower disc 16*a*, disrupting the latter and forcing the support disc 100 through the retaining ring 18*a* into the lower end of the catcher 14 below the outlet openings 13, the catcher end acting as a stop 24 (FIG. 3). Under the condition just described, fluid can flow through the side pocket perforations 11 and body ports 15 to the interior of the latter, passing downwardly through the opened atmospheric chamber 22 in the mandrel and into the catcher 14 for discharge through the outlet openings 23 into the interior of the tubing string T.

A lower packing unit 25 is mounted on the mandrel 13, being confined between the upper end of the catcher 14 and a shoulder 101 on the mandrel; whereas, an upper packing 26 is disposed on the body, being confined between a shoulder 27 on the upper body and the lower end of an adapter 28 threadedly secured to the upper end of the body 12, this adapter being threadedly connected to a stop member 28*a* having an external flange 29 adapted to engage a companion landing shoulder or seat 30 in the side pocket mandrel. When the stop member 28*a* seats on the landing shoulder 30, the upper packing unit 26 sealingly engages the inner wall 31 of the side pocket above its perforations 11, the lower packing unit 13 engaging the inner wall of the side pocket below the perforations 11.

As disclosed, the valve apparatus 10 can be installed initially in the tubing string T before the latter is run into the well casing C and into sealing relation to the well packer P, or it can be lowered through the tubing string and into the side pocket mandrel M to seat in the latter in a position disclosed in the Figures after the tubing string is in place. A suitable latch and retrieving head L of a known type is disclosed in the drawings, which is specifically illustrated and described in U.S. Pat. No. 3,827,493, and which per se forms no part of the present invention. As shown, a retrievable latching device 32 includes the stop member 28*a* connected to the adapter 28 and is threadedly connected to the upper end of the body, the stop member resting on the landing shoulder 30. This stop member is threadedly secured to the lower end of a locking rod or stem 33 having a pointed head 34 and a shoulder 35 at the lower end of the head, to be engaged with a suitable running tool (not shown) for lowering the valve apparatus in the tubing string and into the side pocket mandrel M. A locking sleeve 36 is slidably mounted on the rod or stem 33, being initially secured thereon by a transverse shear pin 37 in the lower position disclosed in FIG. 2*a*, in which its lower end engages the member 28*a*. The upper end of this sleeve includes a shoulder 38 to be engaged by a pulling tool (not shown) for releasing the latching apparatus and removing it from the side pocket mandrel and through the well production tubing T to the top of the well bore. The lower end of the sleeve 36 has an enlargement 39 which can be surrounded by a locking ring 40, which is urged to its lower position disclosed in FIG. 2*a* by a helical compression spring 41 bearing against the ring with its upper end seating against a shoulder 38*a*.

When the latching device 32 is lowered through the tubing string T, the valve apparatus 10 will pass into the side pocket M and the lock ring 40 will engage a latching shoulder 42 in the side pocket disposed above the landing shoulder 30, the locking ring 40 being prevented from moving downwardly past the locking shoulder 42. The remainder of the latch device 32 continues to move downwardly with respect to the ring 40 to remove the enlargement 39 from the ring until a smaller diameter portion 43 of the locking sleeve, disposed above a bevelled sleeve shoulder 44 extending upwardly from the enlargement 39, permits the locking ring to be cammed laterally by the latching shoulder 42. The locking ring 40 can then move past the latch shoulder 42. Once below the latch shoulder, the helical spring 41 will expand and shift the lock ring 40 to its lowermost position in which it surrounds the sleeve enlargement 39, retaining the lock ring in a position for engagement with the inclined lower portion 42*a* of the latching shoulder, which will limit the extent of upward movement of the valve 10 in the side pocket M.

When the valve 10 is to be released and removed from the side pocket, a suitable pulling tool (not shown) is lowered through the tubing string T, passing over the locking sleeve 36 into a position of engagement with the sleeve shoulder 38; whereupon an upward pull can be taken on the locking sleeve 36 to elevate the entire apparatus in the side pocket until the lock ring 40 engages the latching shoulder 42. An increase in the upward pull will then shear the shear pin 37 and cause the locking sleeve to move upwardly limited by its engagement with the stop shoulder 35, shifting the sleeve enlargement 39 above the locking ring 40 and permitting the latter to shift laterally out of engagement from the latching shoulder 42, thereby effectively releasing the entire valve mechanism 10 in the side pocket mandrel for removal through the tubing string T to the top of the well bore.

With the valve apparatus in place, the disc 16 is initially intact and will prevent any fluid from entering the chamber 22 defined between the disc 16 and the lower disc 16*a*, this chamber retaining at atmospheric pressure, although, if desired, a suitable gas, such as nitrogen, can be provided in the chamber under a desired low pressure above atmospheric (FIGS. 2*a*, 2*b*). Assuming the chamber to contain air at atmospheric pressure, the upper disc is subject to the pressure of the fluid in the annulus A between the well production tubing T and the casing C. The upper disc is not subject to the pressure of the fluid in the tubing string T because of the presence of the upper and lower packing or seal units 26, 25 disposed on opposite sides of the side pocket perforations 11. The tubing pressure cannot disrupt the lower disc since it is backed up by the support ring 100 engaging the mandrel shoulder 13*a*. Fluid pressure in the tubing string exerts forces equally in an upward and in a downward direction on the valve apparatus so that such pressure can have no net effect on the valve apparatus in either direction.

The upper rupturable disc 16 is selected to fracture at a predetermined pressure in excess of the hydrostatic pressure of the fluid in the tubing-casing annulus. As an example, discs may be used having a pressure rating of 3,000, 3,500, 4,000, 8,000, 9,000, etc. psi. The pressure rating of the disc selected will be appreciably greater than the hydrostatic pressure of the fluid in the tubing-casing annulus. When the disc is to be ruptured, the annulus fluid pressure is increased above the normal hydrostatic pressure. When the pressure rating of the upper disc is exceeded, it will rupture and the hydrostatic head of fluid and the increase in the pressure of the fluid provided at the surface will pass into the atmospheric chamber 22 and disrupt the lower disc, ejecting the support ring from the mandrel, which will drop to the bottom of the catcher 14, fully opening the outlet openings 23 (FIG. 3). The kill fluid can then be pumped down or will flow from the annulus A and through the open valve apparatus and into the tubing string T, from where it will exert its force against the fluid under pressure in the well production zone. Sufficient fluid can be pumped through the annulus A into the well to kill the well.

In the event the tubing string T leaks, communication will be stablished between the interior of the tubing string and the tubing-casing annulus A. Higher pressure fluid in the well production tubing can then pass into the tubing-casing annulus and increase its pressure. If the total pressure in the annulus then exceeds the pressure rating of the disc 16, the latter will be disrupted and permit the kill fluid in the tubing-casing annulus to flow through the valve 10 into the tubing string, providing an offsetting pressure to kill the well. If the pressure in the casing C, resulting from the tubing leak, were to become excessive, the fluid under pressure would be relieved by the opening of the control valve 10.

It is, accordingly, apparent that a well control valve has been provided, in which opening of the valve is independent of the tubing pressure, since the downstream side of the disc is exposed to atmospheric pressure only, and not to the tubing pressure. The total pressure at which the disc 16 is to rupture for the purpose of opening the valve is predetermined and the appropriate strength or thickness of disc selected. It is only necessary to increase the pressure of the fluid in the annulus A sufficiently above the hydrostatic pressure of the fluid to effect rupture of the upper disc and lower disc. This increase in pressure is completely independent of the pressure in the tubing string. The kill fluid can enter the well at a high rate, overcoming any tendency for the well to continue producing as may happen if kill fluid enters the well at a comparatively low rate. As indicated above, the control valve can be incorporated in the tubing string before the latter is run into the well bore, or it can be lowered into place after it has been appropriately related to the well packer in the well bore above the casing perforations. After the well has been killed, the valve is readily retrievable by use of a suitable pulling tool that becomes connected to the latching device. Another control valve can then be lowered through the tubing string into appropriate position to effect a closure between the tubing-casing annulus A and the interior of the tubing string T.

By employing the atmospheric chamber 22, a constant base pressure is provided on the upstream side of the rupturable disc 16 against which the annulus pressure acts. The tripping pressure of the disc 16 is a function of the strength of the disc only, and is in no manner affected by tubing pressure or temperature fluctuations, inasmuch as the tubing pressure cannot act on the disc at all. The atmospheric chamber is closed initially by the rupturable discs, and their impervious bond to their supports which prevent gas from leaking into the atmospheric chamber and building up a pressure opposing the pressure in the tubing-casing annulus.

The apparatus embodies a check valve 200 which will permit fluid to flow from the tubing-casing annulus A into the tubing string but will prevent fluid from flowing in a reverse direction. As illustrated in the drawings, a check valve is embodied in the body 12, including a valve sleeve 201 slidable within a cylinder bore 202 in the upper body section above the ports 15. This sleeve has a central passage 203 completely therethrough, and includes an upper annular piston portion 204 slidable along the wall 205 of the cylinder and a lower head 206 adapted to move downwardly into engagement with the upper shear disc retaining ring 18, to effect a metal to metal seal therewith, the retaining ring functioning as a valve seat. A suitable seal 207 is mounted on the piston for slidable sealing engagement with the wall 205 of the cylinder. A helical compression spring 208 in the cylinder bears against the upper end of the bore 202 and against the sleeve 201, urging the latter downwardly into engagement with its companion ring seat 18.

It is to be noted that the seal diameter between the upper piston 204 and the cylinder wall 205 is greater than the seal diameter of the valve head 206 against the retaining ring 18. This results in a difference in area R against which the pressure can act on the valve sleeve, either to shift the sleeve upwardly to an open condition with respect to its companion seat 18, or to shift the sleeve in a downward direction into engagement with its companion seat. In the event the apparatus is run into the well already located in the side pocket mandrel M, or if it is run in the well on a wire line through the tubing string and then positioned in the side pocket mandrel, the hydrostatic pressure in the tubing-casing annulus will operate in an upward direction over the annular differential area R of the valve 201, shifting it upwardly against the force of the spring 208 to an open condition and permitting the fluid to enter the space 202 within the upper body section above the upper rupturable disc 16. Such fluid pressure can be increased sufficiently for the purpose of rupturing the upper and lower discs, in the same manner as if the valve were not present within the upper body section 12.

After the discs have both been sheared, the valve sleeve 201 will be held in its open position by the pressure of the kill valve fluid. In the event of the pressure in the tubing T exceeding the pressure in the tubing-casing annulus A, the spring 208 will force the sleeve 201 downwardly into engagement with its valve seat 18, and will be held in that position by the differential pressure acting across the annular area R between the upper seal 207 on the sleeve and the sealing diameter of the head 206 against the valve seat 18. Thus, fluid can flow from the tubing-casing annulus to the interior of the tubing string, by holding the sleeve valve member 21 upwardly, spaced from the retaining ring or seat 18, but the fluid cannot flow in a reverse direction from the tubing string to the tubing-casing annulus since the sleeve 201 will be shifted and maintained in a downward position against this companion seat 18.

I claim:

1. Control valve apparatus for use in a tubular string disposed in a well bore having a producing formation: comprising a metallic valve body structure having an inlet opening, an outlet opening, and a fluid passage between said openings, first metallic closure means in said body structure to one side of said inlet opening closing and passage and movable to open position when subjected to a predetermined fluid pressure in said inlet opening, second metallic closure means in said body structure to one side of said outlet opening and spaced from said first closure means to provide a confined portion of said passage between said first and second closure means into which fluid internally and externally of the tubing string cannot enter, said first and second closure means being fixed to said body structure by fluid impervious means forming metal seals therewith, subjecting said first closure means to said predetermined fluid pressure effecting opening of said confined portion of said passage to permit said fluid pressure to enter said confined portion and shift said second closure means to open position permitting fluid flow through said inlet opening, confined portion, and outlet opening.

2. Control valve apparatus as defined in claim 1; said first closure means comprising a first disruptable disc secured in said body structure and extending across said passage, said second closure means comprising a second disruptable disc secured to said body structure and extending across said passage.

3. Control valve apparatus as defined in claim 1; said first closure means comprising a first disruptable disc joined to said body structure by a metal bond and extending across said passage, said second closure means comprising a second disruptable disc joined to said body structure by a metal bond and extending across said passage

4. Control valve apparatus as defined in claim 1; said first closure means comprising a first disruptable disc extending across said passage with one side of said first disc bearing against said body structure, a first retaining ring bearing against the opposite side of said first disc, said fluid impervious means securing said first disc to said body structure and first retaining ring, said second closure means comprising a second disruptable disc extending across said passage with one side of said second disc bearing against said body structure, a second retaining ring bearing against the opposite side of said second disc, and said fluid impervious means securing said second disc to said body structure and second retaining ring.

5. Control valve apparatus as defined in claim 1; said first closure means comprising a first disruptable disc extending across said passage with one side of said disc bearing against said body structure, a first retaining ring bearing against the opposite side of said first disc, said fluid impervious means comprising a metal bond securing said first disc to said body structure and retaining ring, said second closure means comprising a second disruptable disc extending across said passage with one side of said second disc bearing against said body structure, a second retaining ring bearing against the opposite side of said second disc, and said fluid impervious means comprising a metal bond securing said second disc to said body structure and second retaining ring.

6. Control valve apparatus as defined in claim 1; said first closure means comprising a first disruptable disc secured in said body structure and extending across said passage, said second closure means comprising a second disruptable disc secured to said body structure and extending across said passage, and support means in said confined passage portion extending across and engaging said second disruptable disc to prevent movement of said second disc inwardly of said confined passage portion.

7. Control valve apparatus as defined in claim 1; said first closure means comprising a first disruptable disc metal bonded to said body structure and extending across said passage, said second closure means comprising a second disruptable disc metal bonded to said body structure and extending across said passage, and support means in said confined passage portion extending across and engaging said second disruptable disc to prevent movement of said second disc inwardly of said confined passage portion.

8. Control valve apparatus as defined in claim 1; said first closure means comprising a first disruptable disc extending across said passage with one side of said first disc bearing against said body structure, a first retaining ring bearing against the opposite side of said first disc, said fluid impervious means securing said first disc to said body structure and first retaining ring, said second closure means comprising a second disruptable disc extending across said passage with one side of said second disc bearing against said body structure, a second retaining ring bearing against the opposite side of said second disc, and said fluid impervious means securing said second disc to said body structure and second retaining ring, and support means in said confined passage portion extending across and engaging said second disc.

9. Control valve apparatus as defined in claim 1; said first closure means comprising a first disruptable disc extending across said passage with one side of said disc bearing against said body structure, a first retaining ring bearing against the opposite side of said first disc, said impervious means comprising a metal bond securing said first disc to said body structure and retaining ring, said second closure means comprising a second disruptable disc extending across said passage with one side of said second disc bearing against said body structure, a second retaining ring bearing against the opposite side of said second disc, said impervious means comprising a metal bond securing said second disc to said body structure and second retaining ring, and support means in said confined passage portion extending across and engaging said second disruptable disc to prevent movement of said second disc inwardly of said confined passage portion.

10. Control valve apparatus as defined in claim 1; said confined portion of said passage initially containing a gas at substantially atmospheric pressure.

11. Control valve apparatus as defined in claim 1; said first closure means comprising a first disruptable disc located below said inlet opening and at the upper end of said confined passage portion, said second closure means comprising a second disruptable disc located above said outlet opening and at the lower end of said confined passage portion.

12. Control valve apparatus as defined in claim 11; said confined portion of said passage initially containing a gas at substantially atmospheric pressure.

13. Control valve apparatus as defined in claim 1; and a check valve in said body structure between said inlet opening and first closure means permitting fluid flow from said inlet opening to said outlet opening but preventing fluid flow from said outlet opening to said inlet opening.

14. Control valve apparatus as defined in claim 1; and a check valve in said body structure between said inlet opening and first closure means permitting fluid flow from said inlet opening to said outlet opening but preventing fluid flow from said outlet opening to said inlet opening, said check valve including a sleeve shiftable to open position by a greater pressure of fluid in said inlet opening than in said outlet opening and shiftable to closed position by greater pressure of fluid in said outlet opening than in said inlet opening.

15. Control valve apparatus as defined in claim 1; and a check valve in said body structure between said inlet opening and first closure means permitting fluid flow from said inlet opening to said outlet opening but preventing fluid flow from said outlet opening to said inlet opening, said check valve including a sleeve shiftable to open position by a greater pressure of fluid in said inlet opening than in said outlet opening and shiftable to closed position by greater pressure of fluid in said outlet opening than in said inlet opening, said check valve including a seat in said body structure and a cylinder in said body structure, said sleeve having a passage therethrough, an annular piston portion in said cylinder, and a head adapted to close against said seat, the seal diameter of said piston portion against said cylinder being greater than the seal diameter of said head against said seat.

16. Apparatus for controlling fluid flow in a well bore from a producing formation: comprising a tubular string disposed in the well bore and communicating with said producing formation, a valve device in the tubular string for controlling fluid flow between the well bore annulus surrounding said tubular string and the interior of said tubular string, including a metallic valve body structure having an inlet opening communicating with the well bore annulus, an outlet opening communicating with the interior of said tubular string, and a fluid passage between said openings, first metallic closure means in said body structure to one side of said inlet opening closing said passage and movable to open position when subjected to a predetermined pressure in said annulus and inlet opening, second metallic closure means in said body structure to one side of said outlet opening and spaced from said first closure means to provide a confined portion of said passage between said first and second closure means into which fluid from said annulus and fluid from said tubular string cannot enter, said first and second closure means being fixed to said body structure by fluid impervious means forming metal seals therewith, subjecting said first closure means to said predetermined fluid pressure in said annulus effecting opening of said confined portion of said passage to permit said fluid pressure to enter said confined portion and shift said second closure means to open position permitting fluid flow from said annulus through said inlet opening, confined portion, and outlet opening to the interior of said tubular string.

17. Apparatus as defined in claim 16; said first closure means comprising a first disruptable disc secured in said body structure and extending across said passage, said second closure means comprising a second disruptable disc secured to said body structure and extending across said passage.

18. Apparatus as defined in claim 16; said confined portion of said passage initially containing a gas at substantially atmospheric pressure.

19. Apparatus as defined in claim 16; said first closure means comprising a first disruptable disc secured to said body structure by a metal bond and extending across said passage, said second closure means comprising a second disruptable disc secured to said body structure by a metal bond and extending across said passage.

20. Apparatus as defined in claim 16; said first closure means comprising a first disruptable disc extending across said passage with one side of said first disc bearing against said body structure, a first retaining ring bearing against the opposite side of said first disc, said impervious means securing said first disc to said body structure and retaining ring, said second closure means comprising a second disruptable disc extending across said passage with one side of said second disc bearing against said body structure, a second retaining ring bearing against the opposite side of said second disc, and said impervious means securing said second disc to said body structure and second retaining ring.

21. Apparatus as defined in claim 16; said first closure means comprising a first disruptable disc extending across said passage with one side of said disc bearing against said body structure, a first retaining ring bearing against the opposite side of said first disc, said fluid impervious means bonding said first disc to said body structure and retaining ring, said second closure means comprising a second disruptable disc extending across said passage with one side of said second disc bearing against said body structure, a second retaining ring bearing against the opposite side of said second disc, and said fluid impervious means bonding said second disc to said body structure and second retaining ring.

22. Apparatus as defined in claim 16; said first closure means comprising a first disruptable disc secured to said body structure and extending across said passage, said second closure means comprising a second disruptable disc secured to said body structure and extending across said passage, and support means in said confined passage portion extending across and engaging said second disruptable disc to prevent movement of said second disc inwardly of said confined passage portion.

23. Apparatus as defined in claim 16; said first closure means comprising a first disruptable disc secured to said body structure by a metal bond and extending across said passage, said second closure means comprising a second disruptable disc secured to said body structure by a metal bond and extending across said passage, and support means in said confined passage portion extending across and engaging said second disruptable disc to prevent movement of said second disc inwardly of said confined passage portion.

24. Apparatus as defined in claim 16; said first closure means comprising a first disruptable disc extending across said passage with one side of said first disc bearing against said body structure, a first retaining ring bearing against the opposite side of said first disc, said fluid impervious means securing said first disc to said body structure and first retaining ring, said second closure means comprising a second disruptable disc extending across said passage with one side of said second disc bearing against said body structure, a second retaining ring bearing against the opposite side of said second disc, and said fluid impervious means securing said second disc to said body structure and second retaining ring, and support means in said confined passage portion extending across and engaging said second disc.

25. Apparatus as defined in claim 16; said first closure means comprising a first disruptable disc extending across said passage with one side of said disc bearing against said body structure, a first retaining ring bearing against the opposite side of said first disc, said fluid impervious means bonding said first disc to said body structure and retaining ring, said second closure means comprising a second disruptable disc extending across said passage with one side of said second disc bearing against said body structure, a second retaining ring bearing against the opposite side of said second disc, said fluid impervious means bonding said second disc to said body structure and second retaining ring, and support means in said confined passage portion extending across and engaging said second disruptable disc to prevent movement of said second disc inwardly of said confined passage portion .

26. Apparatus as defined in claim 16; and a check valve in said body structure between said inlet opening and first closure means permitting fluid flow from said inlet opening to said outlet opening but preventing fluid flow from said outlet opening to said inlet opening.

27. Apparatus as defined in claim 16; and a check valve in said body structure between said inlet opening and first closure means permitting fluid flow from said inlet opening to said outlet opening but preventing fluid flow from said outlet opening to said inlet opening, said check valve including a sleeve shiftable to an open position by a greater pressure of fluid in said inlet opening than in said outlet opening and shiftable to closed position by greater pressure of fluid in said outlet opening than in said inlet opening.

28. Apparatus as defined in claim 16; and a check valve in said body structure between said inlet opening and first closure means permitting fluid flow from said inlet opening to said outlet opening but preventing fluid flow from said outlet opening to said inlet opening, said check valve including a sleeve shiftable to open position by a greater pressure of fluid in said inlet opening than in said outlet opening and shiftable to closed position by greater pressure of fluid in said outlet opening than in said inlet opening, said check valve including a seat in said body structure and a cylinder in said body structure, said sleeve having a passage therethrough, an annular piston portion in said cylinder, and a head adapted to close against said seat, the seal diameter of said piston portion in said cylinder being greater than the seal diameter of said head against said seat.

29. Apparatus as defined in claim 1; including check valve means in said body for only permitting fluid flow from said inlet opening to said outlet opening.

30. Apparatus as defined in claim 16; including check valve means in said body for only permitting fluid flow from said inlet opening to said outlet opening.

31. Control valve apparatus for use in a side pocket of a production tubing disposed in a well bore to allow the flow of fluid from the tubing-well bore annulus into the tubing through an opening between the side pocket and the annulus comprising: an elongated body having a flow passage therethrough; axially spaced sealing means on said body for straddling said opening; an inlet in said body communicating with said passage between said sealing means for communicating said passage with said opening; an outlet from said passage for communicating said passage with said tubing; axially spaced fluid pressure disruptable inlet and outlet metal discs between said inlet and said outlet defining in said passage a confined portion openable by fluid flow from said inlet to said outlet; and means forming fluid impervious metal seals between said discs and said body to maintain gas in said confined portion .

32. Control valve apparatus as defined in claim 31; including reinforcing means between said body and said outlet disc for preventing reverse flow from said outlet to said inlet.

33. Control valve apparatus as defined in claim 31; said fluid impervious seals being formed by a metal bond between said discs and said body.

34. Control valve apparatus as defined in claim 31; including a check valve means in said body for only permitting fluid flow from said inlet opening to said outlet opening.

* * * * *